US010801797B2

(12) United States Patent
Cheng

(10) Patent No.: US 10,801,797 B2
(45) Date of Patent: Oct. 13, 2020

(54) MUZZLE DEVICE

(71) Applicant: Justin Peijay Cheng, Riverside, CA (US)

(72) Inventor: Justin Peijay Cheng, Riverside, CA (US)

( * ) Notice: Subject to any disclaimer, the term of this patent is extended or adjusted under 35 U.S.C. 154(b) by 1 day.

(21) Appl. No.: 16/158,282

(22) Filed: Oct. 11, 2018

(65) Prior Publication Data

US 2019/0128633 A1 May 2, 2019

Related U.S. Application Data

(60) Provisional application No. 62/571,139, filed on Oct. 11, 2017.

(51) Int. Cl.
*F41A 21/36* (2006.01)
*F41A 21/38* (2006.01)

(52) U.S. Cl.
CPC ..... *F41A 21/38* (2013.01)

(58) Field of Classification Search
CPC ..... F41A 21/36; F41A 21/38; F41A 21/30; F41A 21/34
See application file for complete search history.

(56) References Cited

U.S. PATENT DOCUMENTS 3,155,003 A * 11/1964 Ruth ..... F41A 21/36 89/14.2
5,675,107 A * 10/1997 Ledys ..... F41A 21/36 89/14.05
2016/0091269 A1* 3/2016 Miller, III ..... F41A 21/36 89/14.3
2017/0191782 A1* 7/2017 Bray ..... F41A 21/36
2017/0261282 A1* 9/2017 Griffitts ..... F41A 21/36

* cited by examiner

*Primary Examiner* — J. Woodrow Eldred
(74) *Attorney, Agent, or Firm* — Kleinberg & Lerner, LLP; Marvin H. Kleinberg

(57) ABSTRACT

The present invention is of a muzzle device that is either permanently fixed or releasably attached to the end of the barrel of a firearm. The muzzle device may have a configuration that reduces the loss of pressure and flow rate of the propellant gas by employing a central bore having approximately the same diameter as the bore of the barrel. The muzzle device may further have apertures with inserted adjustable screws with hollow interior portions for tuning the degree of propellant gases in various directions away from the muzzle device. The external diameter of the muzzle device may also have substantially the same diameter as the external diameter of the barrel to allow for access to firearm components without having to remove the muzzle device from the end of the barrel.

11 Claims, 8 Drawing Sheets

MUZZLE DEVICE

FIELD OF THE INVENTION

The invention relates generally to firearms and firearm accessories, and more particular, the invention relates to muzzle devices such as muzzle brakes and compensators. The muzzle device may be permanently fixed or releasably attached to the firearm. The present invention may be used in any type of firearm.

BACKGROUND OF THE INVENTION

Previous muzzle attachments employ an internal expansion chamber, i.e. a muzzle attachment with interior chambers that are significantly wider than the diameter of the central bore. These interior chambers allow propellant gases to expand within the muzzle attachment before being expelled from apertures on the external surface of the muzzle attachment. This causes the pressure of the propellant gas to lower, thereby reducing the flow rate as it is being redirected from the central bore. The benefits of minimizing recoil and improving accuracy through directed release of high pressure gas is thereby lost.

Prior art muzzle attachments may also have grub screws that may be used to adjust propellant gas release from the external apertures. However, such grub screws may reduce propellant gas release due to the absence of any additional vents within the grub screw structure. Such a loss may reduce the ability to precisely modulate the desired balance of propellant gas expulsion as well as reduce recoil compensation.

INVENTION SUMMARY

The present invention is of a muzzle device that is either permanently fixed or releasably attached to the end of the barrel of a firearm. It is conceivable that the muzzle device may also be used on a canon. The muzzle device may have a configuration that reduces the loss of pressure and flow rate of the propellant gas by employing a central bore having a substantially equal diameter to the bore of the barrel. The muzzle device may have a plurality of apertures that are rearwardly angled from the central bore of the muzzle device to the external surface of the muzzle device. External chamfers may be co-located with the apertures to enable the expelled gas to have directed expansion of the propellant gas such that additional pressure is exerted on the external surface of the muzzle device.

The present invention may further have tunable apertures that allow the expulsion of the propellant gas to be adjustably controlled. The apertures are configured to receive screws which may be screwed into the apertures at varying depths within the tunable apertures. The screws may have a hollowed interior portion that allows expulsion of propellant gas albeit less than when the screw is not inserted within the aperture.

The present invention is further directed to a muzzle device having an external diameter that is about equal to the diameter of the barrel. Approximately equal diameters allow the user to access to other components on the barrel of the firearm to be removed such as the gas block or barrel nut of the firearm. Such removal of these components would not necessitate the need to remove the muzzle device.

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

DETAILED DESCRIPTION OF THE INVENTION

The present invention may have an overall cylindrical configuration as shown in the exemplary embodiments in FIGS. 1-8, but also may be configured in other elongated/oblong three-dimensional shapes. The external diameter 42 of the muzzle device when used as firearm accessory may be about equal to the external diameter of the barrel of the firearm, such as the portion of the barrel immediately adjacent to the muzzle of the firearm. See FIG. 1B. The approximate equal diameter enhances compatibility with the firearm and other accessories. For example, when the muzzle device is used as an accessory and attached to the firing end of the barrel, the muzzle device may have a 0.75 inch outer diameter that matches some of the most commonly used automatic rifle barrel profiles such as the AR-15 firearm. Equal diameters of the exterior dimensions of the muzzle device and barrel would eliminate the need to remove the muzzle device from the rifle when accessing the firearm components such as the gas block, barrel nut or any other component located on or near to the proximal end of the barrel. When the muzzle device is permanently fixed to the end of the barrel, there is a greater requirement for the external diameter 42 of the muzzle device to be about equal to the external diameter of the barrel.

In other embodiments, the attachment may have an overall hexagonal prism configuration or any other prismatic configurations with any number of expansion faces. The overall width of the hexagonal prism may be equal to near external diameter of the firearm's barrel so as not to impede access to the firearm components and other accessories.

The muzzle device may be composed of any suitable material(s) known to those skilled in the art. In one embodiment, the firearm accessory may be coated with aluminum titanium nitride.

One of the objects of the present invention is to expel the propellant gases in a directional manner through one or more apertures 4 of the muzzle device 2 located along the longitudinal axis of the muzzle device 2. The muzzle device 2 may have a central bore 6 having a smaller diameter than other previously designed muzzle devices known in the art. The smaller diameter may allow the propellant gases to be expelled at a greater pressure and velocity through the one or more apertures 4 than other previously designed muzzle devices having a larger diameter. In some preferred configurations, the diameter of the central bore may be approximately equal to the diameter of the bore of the barrel of the firearm.

Figure 2:
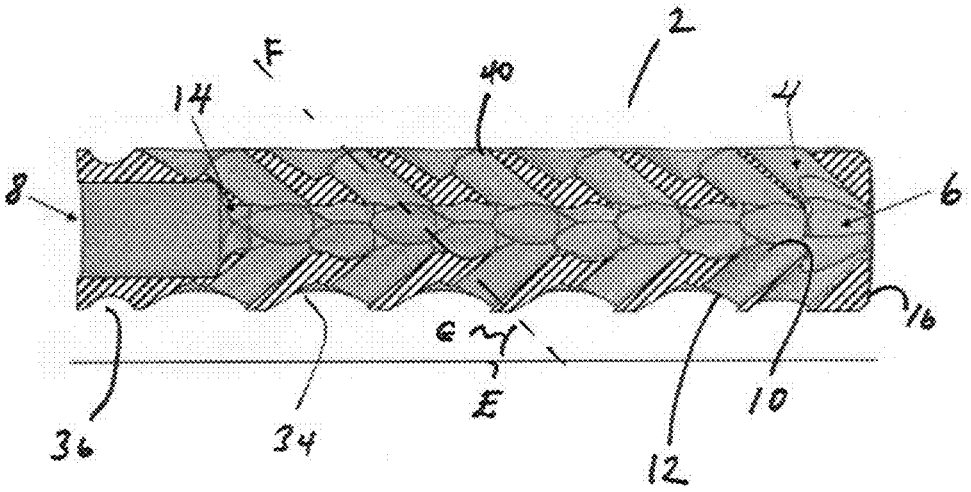
FIG. 2 is a cross-section side plan view of line A-A of the muzzle device.

The muzzle device 2 may have at least one aperture 4 with a smaller diameter aperture than the diameter of the central bore 6. Such a preferred configuration may further increase the gas pressure and velocity through such an aperture 4. In one exemplary embodiment, the aperture may have a diameter of 3/16 of an inch. The central bore diameter of the device may not be substantially greater than the inner diameter of the central bore of the barrel. The longitudinal axis F of the aperture 4 may be configured at any angle relative to the longitudinal axis E of the central bore: perpendicular or at angles that are forwardly slanted or rearwardly slanted. Another example as shown in FIG. 2, has a plurality of apertures 4 configured to be rearwardly slanted with about a 40° angle G between the longitudinal axes of the apertures and the longitudinal axis of the central bore such that the exterior portion of the apertures faces in the direction towards the proximal end 8 of the muzzle device 2.

The apertures 4 of the muzzle device 2 may be uniform in diameter of internal opening 10 (i.e. entry point of the propellant gas) and external opening 12, or the openings may vary in diameter, or increase in diameter from one end of the muzzle device to another. In one preferred embodiment, the diameter of internal opening of the aperture is smaller than the external opening of the aperture where the diameter stochastically increases. The walls of the apertures may form cylinder or form an overall frustum or conical shape. The aperture(s) may also have varying diameters or multiple different angles throughout its length.

The muzzle device 2 may have one or more supplementary apertures 14 which may be used to increase the expulsion of gas and/or have additional functions. For instance, there may be a higher concentration of apertures including a supplementary aperture on any region of the device which would maximize the venting surface area for such a region. Additional apertures located at a region on the muzzle device may reduce the pressure. In one embodiment, the additional apertures near the distal end 16 may be used to further reduce the recoil impulse before the projectile exits the muzzle device 2. These supplementary apertures may be extending generally rearwardly, forwardly, or perpendicularly relative to the central bore. Supplementary apertures may be configured to have a smaller diameter than the central bore of the muzzle device.

In one embodiment, the supplementary aperture may have a dual function. In one embodiment, the supplementary aperture 14 may serve as a slot 26 for an installation tool 18 for attaching the muzzle device 2 to a firearm. An exemplary embodiment in FIG. 3A has two supplementary apertures 14 wherein the longitudinal axes of each are aligned with each other. An installation tool 18 having an insertable shaft 20 that may be inserted and extend through both supplementary apertures simultaneously. The installation tool 18 may be used to assist in screwing or attaching the muzzle device 2 on to the end of the firearm by providing the necessary torque. In this embodiment, the muzzle device 2 would have a proximal end 8 having a diameter capable receiving the end of the barrel of the firearm. The diameter of proximal end's bore 24 would be longer than the diameter of the central bore 6. The interior walls of the proximal end's bore 24 may have a portion that is threaded 22 capable of interfacing with a threaded exterior end of the barrel. Such tool slot 26 would also serve as a venting aperture when the installation tool is not inserted. In prior art muzzle devices, such devices lose venting surface area due to the need to implement wrenching or screwing spot surfaces which lack the incorporation of apertures.

In an alternate embodiment, an installation tool may have at least one shaft that is screwed into an aperture of the muzzle device. The installation tool shaft and the aperture of the muzzle device would have compatible threading to allow shaft and aperture to interface and create a sufficiently stable contact so that the installation tool may be used to attach the muzzle device to the end of the barrel.

Figure 3A:
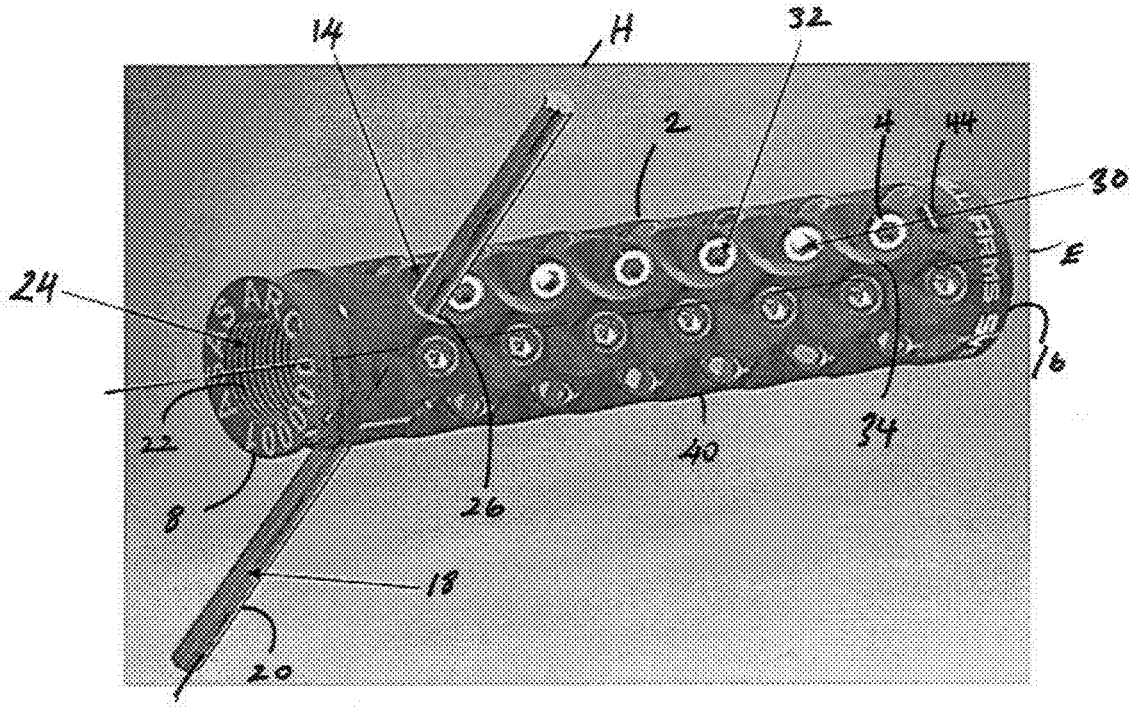
FIG. 3A is a perspective view of the muzzle device and an installation tool.
Figure 3B:
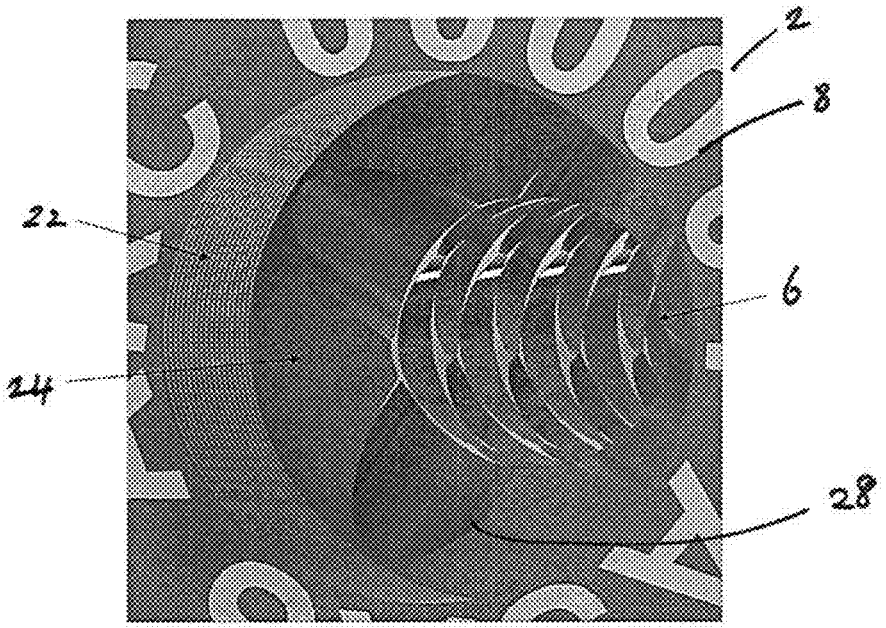
FIG. 3B is a close-up perspective view of the proximal end of the muzzle device.
Figure 4A:
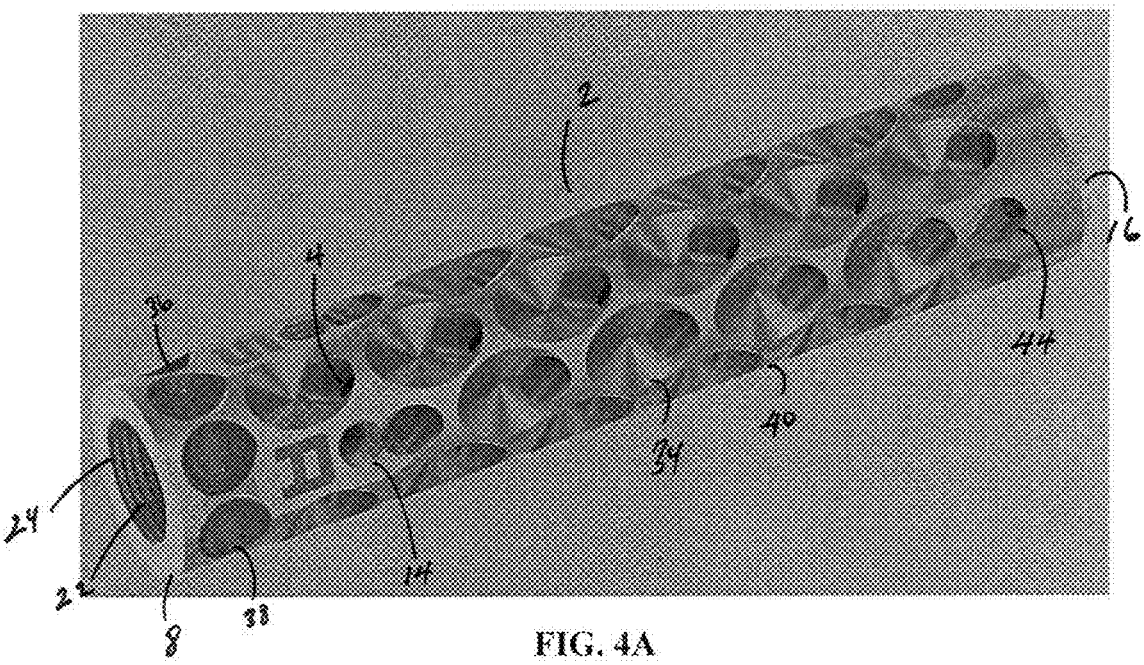
FIG. 4A is a perspective view of another exemplary embodiment of the muzzle device.
Figure 4B:
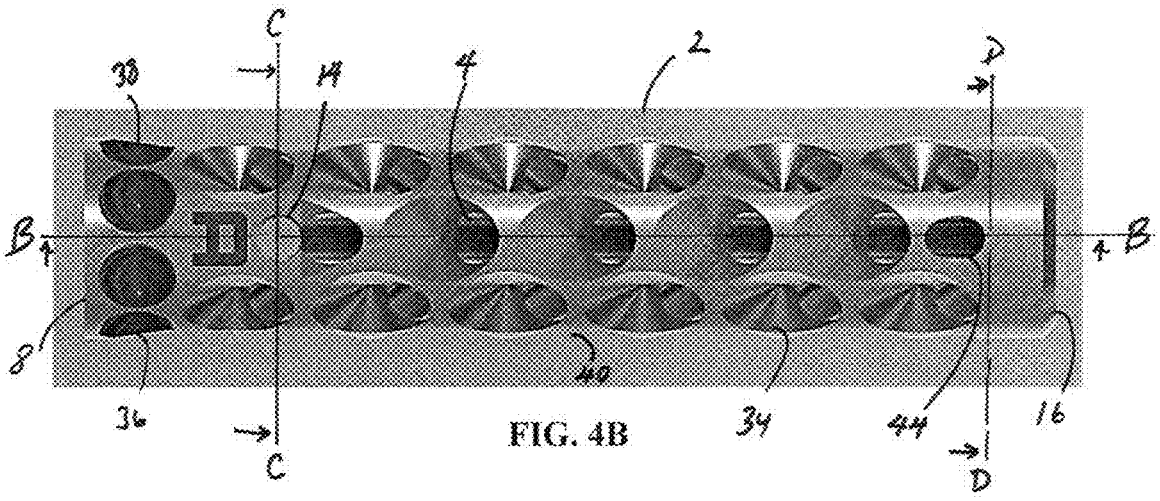
FIG. 4B is a side plan view of the muzzle device.
Figure 5:
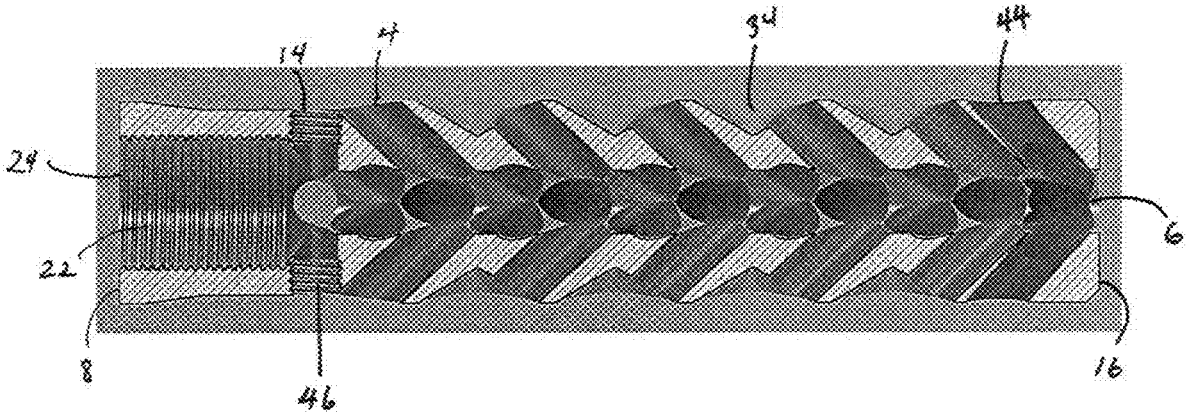
FIG. 5 is a cross-section side plan view of line B-B of the muzzle device.
Figure 6A:
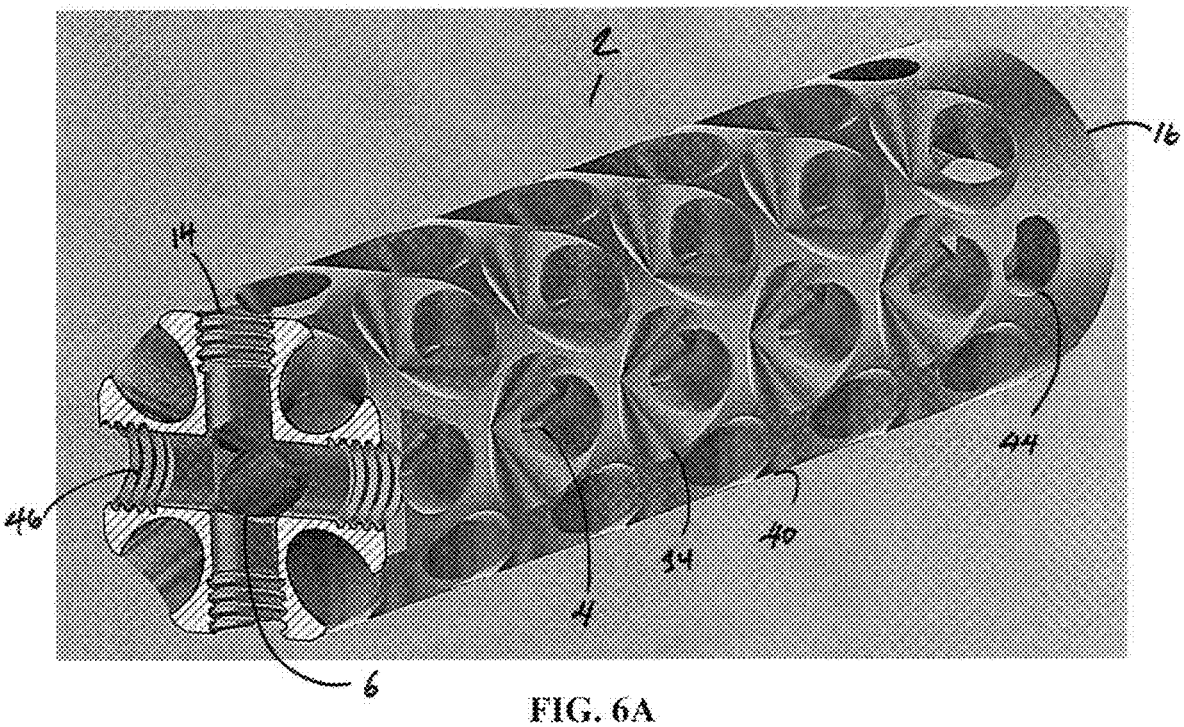
FIG. 6A is a cross-section perspective view of line C-C of the muzzle device.
Figure 6B:
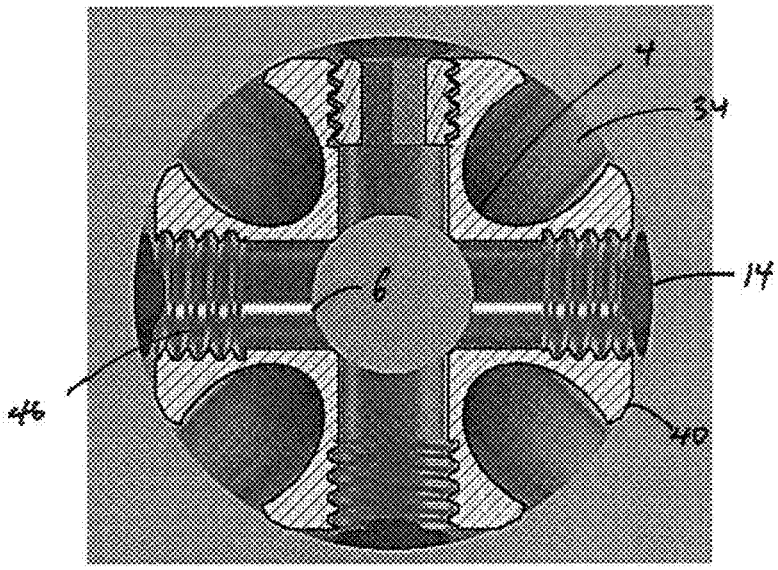
FIG. 6B is a cross-section rear elevation view of line C-C of the muzzle device.
Figure 7:
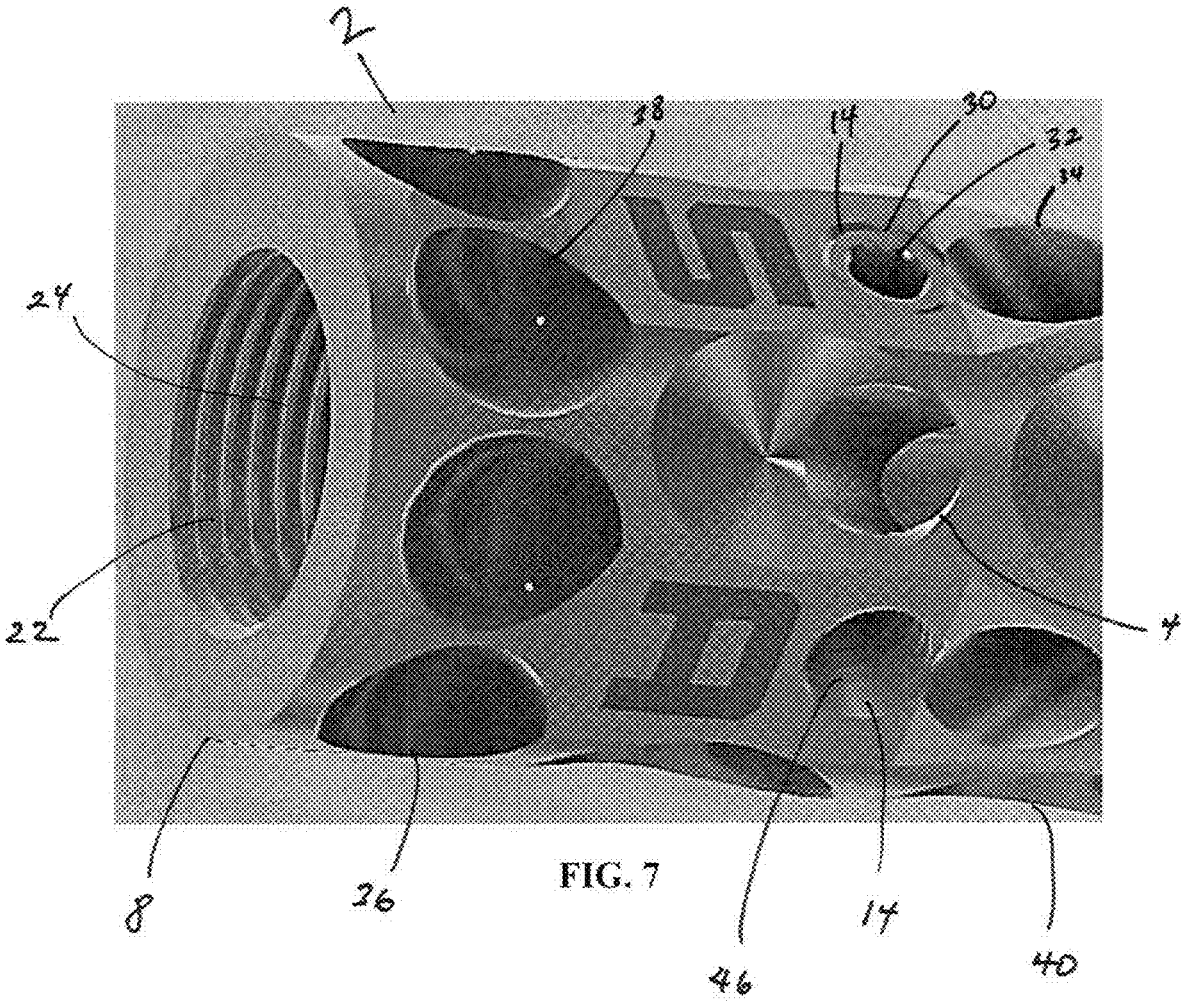
FIG. 7 is a close-up perspective view of the proximal end of the muzzle device.
Figure 8:
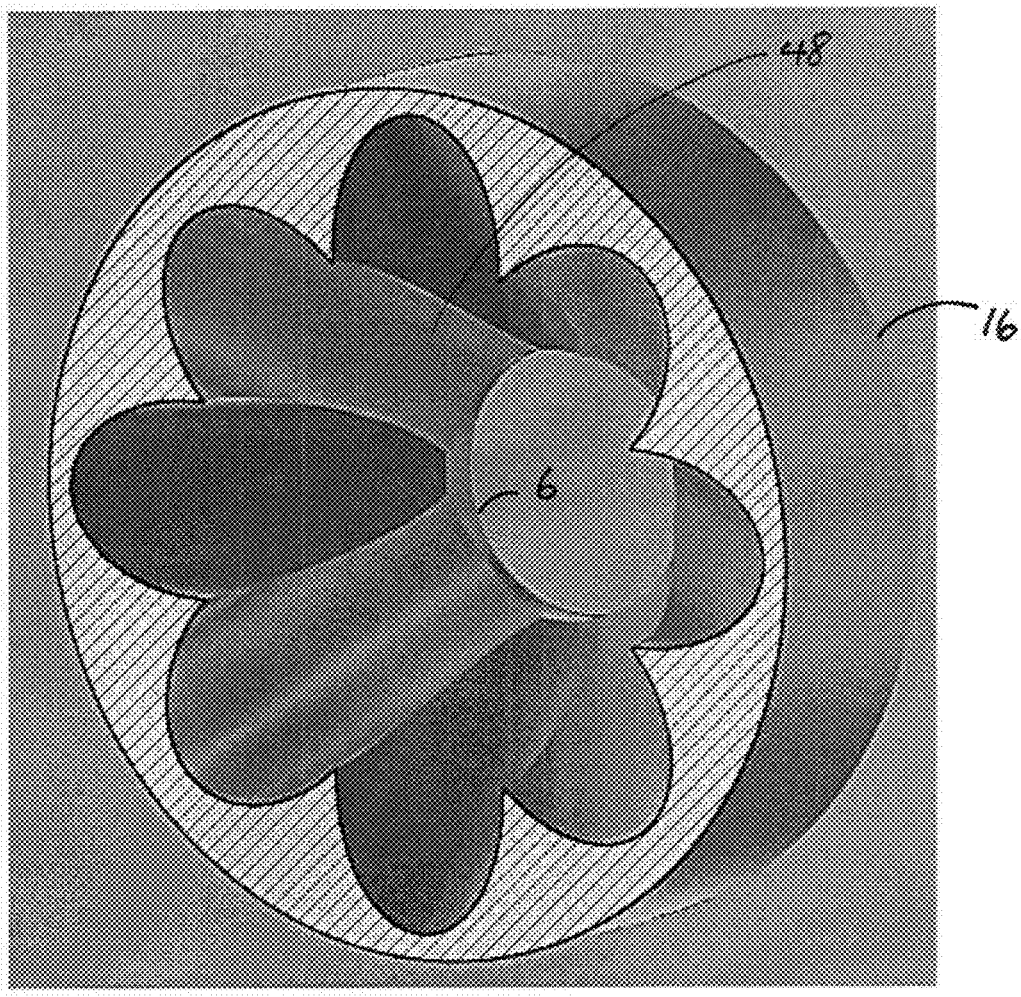
FIG. 8 is a cross-section perspective view of line D-D of the muzzle device.

Another exemplary embodiment in FIGS. 3A-3B and FIG. 5 (i.e. a close-up view of the proximal end of the device) shows threading 22 (i.e. ½-28 Uniform National Extra Fine (UNEF) threaded portions) at the proximal end 8 of the muzzle device 2. The muzzle device 2 may have an interior proximal chamfered region 28 that may be intersected by tool slot apertures configured to receive the installation tool. The longitudinal axis H of the tool slots 26 may run perpendicular to the longitudinal axis E of the central bore of the muzzle device. The interior proximal chamfered region 28 and tool slots 26 may provide a chamber for circumferential internal expansion of gas when the installation tool is not inserted. In one embodiment, the internal proximal chamfered region may be bored out using a ½-28 UNEF 118° drill bit.

In another preferred embodiment, the front end of the muzzle device may have additional distal vents at the distal end the muzzle device in combination with having four supplementary apertures at the proximal end. See FIGS. 1-2, 3A, 4-6A and 8. In one exemplary embodiment, the distal end 16 may have four distal vents 44 to maximize the venting surface area at the end of the muzzle. These distal vents 44 may also be configured to be rearwardly angled away from the central bore 6 towards the external surface of the muzzle device at a similar angle to apertures 4. The distal vents may optionally have external chamfers to enhance directional gas expansion.

A preferred embodiment includes apertures or supplementary apertures may be threaded within the internal walls. Threading may be used to insert screws such as a grub screw. The screws may be used to modify the nature of how the propellant gas is expelled based on the depth in which the screws are located within the apertures and the number of screws inserted into the apertures of the muzzle device. The screws may allow venting by having a hollowed interior portion. The use of inserted vented screws allows the apertures to bleed propellant gases at a slower overall flow rate thus restricting the flow that the aperture without the insertion of the screw. The dimensions of the hollow interior portions within the vented screws may vary which further provide an additional level of fine tuning of recoil characteristics. The hollowed portions 32 of the vented screw 30 may have any three-dimensional shape such as a hexagonal prism as shown in FIG. 3A. Plugs, porous materials, gels, or foams may also be inserted into the hollowed portion of the screw which can be used to further reduce or modify the air permeability. The walls of the hollow interior portions may be threaded to allow a threaded tool to be used to adjust the depth of the screw within the supplementary apertures 14. In the alternate, hollowed interior portions having a hexagonal prism configuration may interface with other tools such as an allen wrench. A non-vented grub screw may also be used to adjustably occlude propellant gases from certain apertures or to allow the use of other accessories or tools with the muzzle device or firearm. In one embodiment such as the one shown in FIGS. 5, 6A, and 6B, the threads used on the vented screw 30 and apertures 4 may conform to ¼-20 UNC (Unified Coarse Thread).

In one preferred embodiment, supplementary apertures 14 may be configured perpendicular to the central bore 6 and allow for the insertion of vented screws 30. In one preferred example, a set of four supplementary apertures 14 and four vented screws 30 may be located near the proximal end 8 of the muzzle device 2. The supplemental apertures 14 may be spaced equally from each other such that four apertures forms a cross configuration. The user may then insert the vented screws 30 and adjust the depth for fine tuning the directional flow of the propellant gas. Supplementary apertures used in combination with the vented screws may vary in the number, spacing, and the aperture diameter and screw configuration.

The hollow interior portion of the vented screw may be also used to insert an installation tool shaft through one or more alighted vented screws. In the alternate, the vented screws may have threading on the walls of the hollow interior portion that may interface with the threading on the shaft of an installation tool. Once the installation tool shaft is inserted into the center opening of the vented screw, the installation tool may be used to screw on or aid in the attachment of the muzzle device to the end of the barrel.

Any of the apertures or supplementary apertures of the muzzle device may have external chamfered portions located at the external end of the aperture. The external chamfered portion 34 may be configured to be concave. The external chamfered portions may extend to any partial depth of the external surface of the muzzle device. The external chamfered portions may be configured to control the expansion of the propellant gas as it is expelled through the aperture. In one exemplary embodiment, the relative position of the aperture 4 within the external chamfered portion 34 may enable the gas to expand in a directional manner. Further to this embodiment, a concave chamfered region 34 may generally have a contour akin to a portion of an ellipsoid. The aperture 4 may be located at the forward portion of each external chamfered region 34 such that the longitudinal axis of the aperture extends rearwardly from the central bore 6 to external chamfered region 34. In other embodiments, the aperture may be located at any location in the external chamfered region. The concave region may have a contour or perimeter shape such as any three-dimensional polygon. The external chamfered portions may be configured as grooves or valleys etched into the surface of the contour. In one embodiment, the external chamfered portions 34 are made with a standardized 15⁄32 inch 118° drill bit.

The apertures 4 of the present invention may be in any pattern. In one embodiment, the ports may be positioned in rows along the longitudinal axis of the muzzle device. The apertures may be positioned in an alternating pattern. In other embodiments, the apertures may be denser in certain regions than others or may form any intricate pattern. For example, there may be more apertures, i.e. apertures 4 and distal vents 44, at the distal end 16 of the muzzle device 2 as shown in FIG. 5 that other regions of the muzzle device such as the mid region. The distal end may also have internal distal chamfers 48 to aid in reducing exhaust pressure at the distal end. See FIG. 8. Adding internal distal chamfers is example of how the distal end may have a greater internal volume of the central bore than the proximal regions of the central bore. The greater number of apertures and the greater internal volume at the distal end allows the exhaust pressure at the distal end to be lower which in turn may help reduce recoil.

Figure 1A:
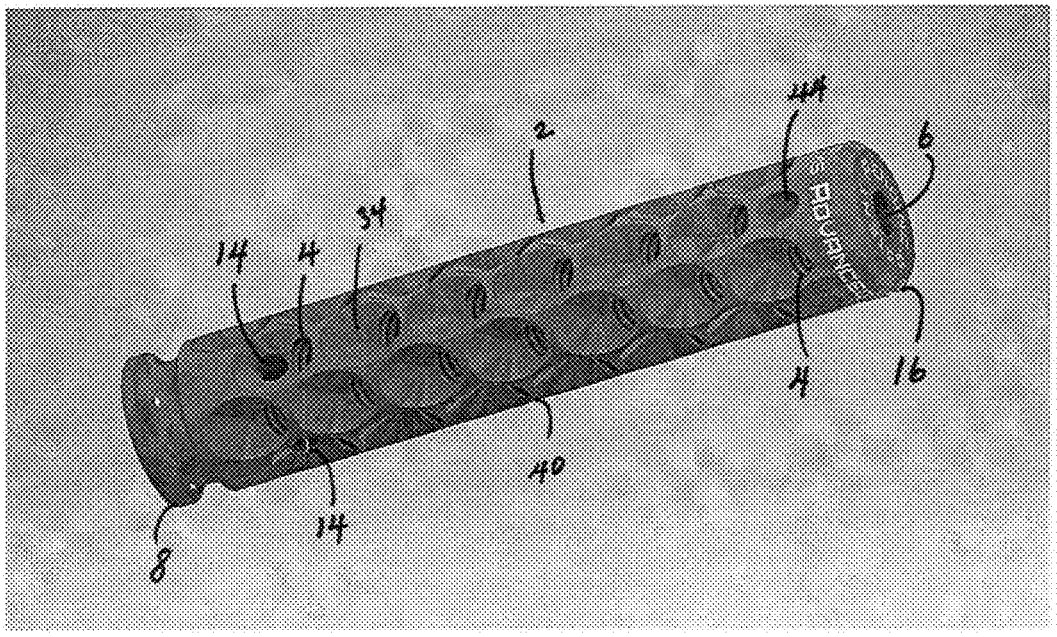
FIG. 1A is a perspective view of an exemplary embodiment of the muzzle device.
Figure 1B:
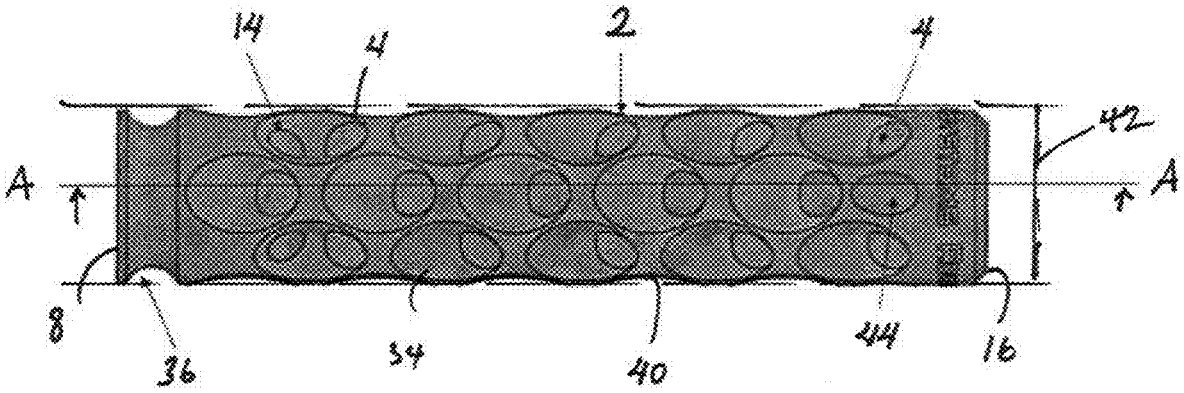
FIG. 1B is a side plan view of the muzzle device.

The proximal end of the muzzle device may have an attachment mechanism when used as an accessory to the firearm. This attachment mechanism may employ the use of a chamfer which may be used as a quick detach ("QD") recess 36 as shown in FIG. 1. In an alternate embodiment shown in FIGS. 4 and 7, the QD recess may be an indent or a plurality of indents 38 formed on the exterior surface of the muzzle device may be used to interface with a compatible ball bearing adapter for QD attachment. The attachment mechanism may also include, either alone or in combination with other mechanisms, direct thread or any other mechanism known to those skilled in the art.

The distal end of the muzzle device may have a portion that also allows for attachment of accessory components. The distal end may have an indexing chamfer for QD attachments, threading or any other means of attachment known in the art. Such attachments may include suppressors, flash suppressors, linear brake, blast diffuser, blast redirector, mechanical counter-recoil systems, or any other attachment known to one skilled in the art.

The muzzle device may be constructed by standardized tooling or any other methods known to those skilled in the art.

While the specification describes particular embodiments of the present invention, those of ordinary skill can devise variations of the present invention without departing from the inventive concept.

What is claimed is:

1. A muzzle device to be attached at an end of a barrel of a firearm comprising:

A proximal end near the end of the barrel, a distal end, an external surface, a central bore extending between the proximal and distal end and aligned with a bore of the barrel;

the central bore having a diameter substantially equal to the diameter of the bore of the barrel;

A plurality of apertures extending from the central bore to an external surface of the muzzle device, the plurality of apertures each having an external opening, and the plurality of apertures being rearwardly angled from the central bore where the external opening is inclined to face the proximal end; and At least one chamfer located on the external surface and the chamfer is co-located with at least one aperture.

2. The muzzle device of claim 1, wherein the at least one aperture co-located with the chamfer is located at the region of the chamfer that is closer to the distal end.

3. The muzzle device of claim 1, wherein at least one aperture has a smaller diameter than the diameter of the central bore.

4. The muzzle device of claim 1, wherein the distal end has a greater number of apertures than other regions of the muzzle device.

5. The muzzle device of claim 1, further comprising at least one supplementary aperture that extends perpendicular from the central bore, the supplementary aperture having an external opening.

6. The muzzle device of claim 5, further comprising more than one supplementary aperture and at least two supplementary apertures having external openings that face opposite directions from each other.

7. The muzzle device of claim 5, wherein the supplementary aperture is configured to receive a shaft of an installation tool used to attach the muzzle device to the end of the barrel.

8. The muzzle device of claim 5, wherein the supplementary aperture is configured to receive a screw, the screw being adjustably located at varying depths.

9. The muzzle device of claim 8, wherein the screw having a hollowed interior portion, the hollowed interior portion having an external opening and an interior opening that faces the central bore.

10. The muzzle device of claim 1 wherein the distal end having a greater internal volume than other regions of the central bore of the muzzle device.

11. The muzzle device of claim 1 wherein the muzzle device having an external diameter, and the external diameter is the same length as an external diameter of the barrel.

* * * * *